US005477998A

United States Patent [19]

Reckler

[11] Patent Number: 5,477,998

[45] Date of Patent: Dec. 26, 1995

[54] TRANSFORMABLE REFLECTIVE GARMENT

[76] Inventor: Lise D. Reckler, 11 rue Saint-Pierre, General Delivery, Sainte-Anne de Madawaska, N. B., Canada, E0L 1G0

[21] Appl. No.: 262,009

[22] Filed: Jun. 17, 1994

[51] Int. Cl.[6] ..... A45C 9/00

[52] U.S. Cl. ..... 224/151; 224/215; 224/224

[58] Field of Search ..... 224/151, 209, 224/215, 216, 218, 224, 226, 228, 236; 362/108; 359/519

[56] References Cited

U.S. PATENT DOCUMENTS

| | | | |
|---|---|---|---|
| 3,989,080 | 11/1976 | Koszegi | 224/151 X |
| 4,483,469 | 11/1984 | Arisland | 224/151 |
| 4,518,107 | 5/1985 | Amos | 224/215 |
| 4,545,414 | 10/1985 | Baum | 224/224 |
| 5,070,436 | 12/1991 | Alexander et al. | 362/108 |

FOREIGN PATENT DOCUMENTS

| | | |
|---|---|---|
| 307244 | 1/1931 | Canada . |
| 334249 | 7/1933 | Canada . |
| 616134 | 3/1961 | Canada . |
| 457177 | 7/1981 | Canada . |

*Primary Examiner*—Renee S. Luebke

[57] ABSTRACT

A reflective garment for improving the visibility of a wearer when light is directed upon him, comprising a harness and a pouch for stowing the harness when it is not being used. The harness has detachable buckles and length adjustment means for varying the position of the shoulder straps from a parallel pattern to a "X" shaped pattern depending upon the preference of the wearer. A limb strap is provided behind the pouch for wearing it, when the harness is contained therein, as a wrist or ankle reflector. The harness-stuffed pouch is also foldable into a cylindrical reflective signal which may be carried on a belt or as a hand held reflective pendant.

20 Claims, 5 Drawing Sheets

TRANSFORMABLE REFLECTIVE GARMENT

FIELD OF THE INVENTION

The present invention relates to reflective garments, and more specifically, to reflective garments which are transformable into a variety of reflective wearable articles.

BACKGROUND OF THE INVENTION

Reflective garments, and especially reflective vests and harnesses are used frequently by fireman, rescue workers, highway patrol officers and miners. The vest or harness increases the visibility of the wearer when light is directed upon him. Hence, reflective garments improve the security of persons working in the dark, and prevent accident to those walking along roadways during evening dusk or at night.

Although many types of reflective vests and harnesses are available commercially, their shape and purpose are not always suitable for wearing by a number of individuals walking along highways.

For example, the protective vest described in U.S. Pat. No. 5,249,106; issued to Barnes et al on Sep. 28, 1993 may be bothersome to the lightly dressed runner, or to those walking short distances to a friend's place. The vest is not practical either for a jogger who carries an extra sweater on his shoulders or a pack sack on his back.

Another example of a reflective garment is the harness described in U.S. Pat. No. 3,901,579 issued to Demerest on Aug. 26, 1975. Many pedestrians may find that the garment does not match the style of a semiformal costume.

Both types of reflective garment may be cumbersome to some for storing between uses, or for carrying along in anticipation of a late return from an evening walk. In that sense, the vest may hardly be folded over and carried in someone's pant pocket. Although the harness is foldable into a compact shape, if it is not contained, it soon returns to a unhandy ball of interlaced ribbons, Consequently, these types of reflective garment are not found when needed, or are simply not worn by those appearance conscious persons.

SUMMARY OF THE INVENTION

In the present invention however, there is provided a combination of a reflective harness and a reflective transformable pouch attached to the front portion of the belt of the harness. The harness and the pouch are made of a highly reflective material of the type described in Canadian patent no. 457,177 issued to Palmquist et al on Jul. 10, 1951.

When the harness is worn, the pouch is used to carry car keys, a wallet, a lunch, candies or things of the like. When the harness is not used, it is folded over and stowed away inside the pouch.

The pouch being made of a reflective material, can be used as a reflector worn on the arm or the leg of a walker to offer similar protection than the harness. For this purpose, a limb band is provided on the back side of the pouch.

The closing of the pouch is done by a folding flap having a piece of gripping material sticking over a piece of mating material. The gripping and mating material is of the type described under the trade name Velcro™.

A second piece of mating material is attached to the lower rear portion of the pouch. The pouch can be folded lengthwise in half and the flap can be stretched over to grip upon this second piece of mating material. Thus, the shape obtained therefrom is a cylindrical reflector of a handy size. The reflective object is easy to store in the glove compartment of a car, in a lady's purse, in the saddle bag of a motorcycle and all other convenient locations where the garment may be readily found when needed. The cylindrical reflector may also be used as a hand held signal to direct traffic on the site of an accident or in a parking area.

When the pouch is so folded, the limb band can be used as a belt hook. The garment may be carried on the belt of a person to offer a limited protection awaiting the wearing of the fully deployed harness.

The pouch is also equipped with a carrying cord such that the cylindrical reflector may be carried as a pendant, offering also a Substantial visual attraction. The cord is another convenient means to carry the reflective garment along for the evening walk or yet to leave it hanging on the frame of a bicycle.

The versatility of this reflective garment which can be stowed away into a handy sized pouch, and transformed into a limb reflector, a hand held signal and a reflective pendant improves the appeal of carrying and wearing reflective protection.

People who could find safety and advantage of wearing the Transformable Reflective Garment are many, and includes; kids going from house to house at Halloween, parents accompanying these kids, bicyclists, boy scouts, joggers, pedestrians, hitch hikers, snowmobilists, hunters, fishermen and motorists.

The present invention is applicable to a variety of circumstances and to a variety of clothing, to satisfy the needs and taste of as many people as possible exposed to the danger of not being seen at night.

BRIEF DESCRIPTION OF THE DRAWINGS

The preferred embodiment of the invention will be further understood from the following description, with reference to the drawings in which.

DETAILED DESCRIPTION OF THE PREFERRED EMBODIMENT

Figure 1:
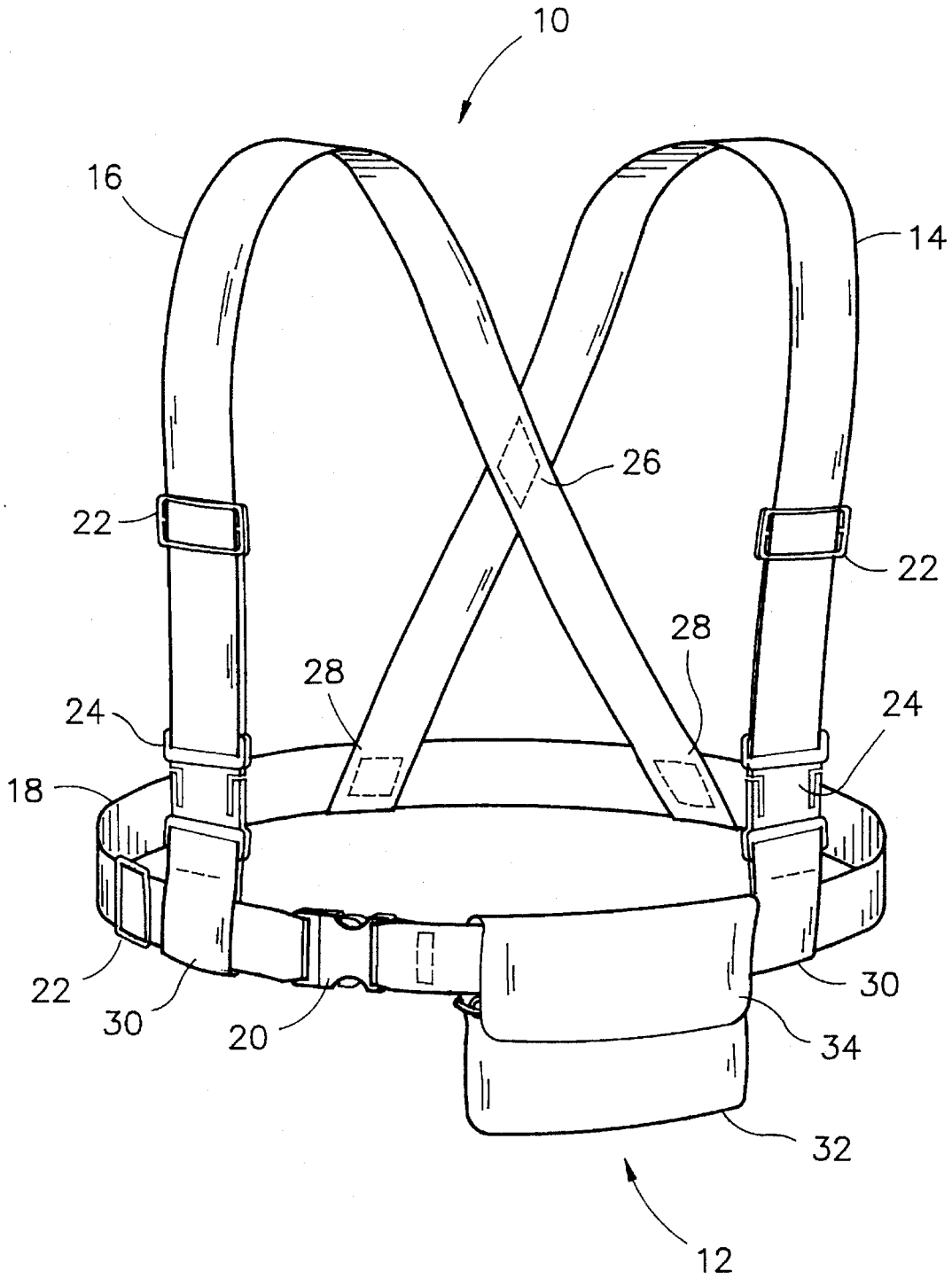
FIG. 1 is an illustration of the preferred embodiment of the transformable reflective garment, viewed from the front.

Referring to FIG. 1, there is illustrated a combination of a harness 10 and a pouch 12. Both items of the combination are made of a highly reflective material of the type reflex-reflective fabric which is flexible, strong, tough and water resistant.

The reflective harness 10 comprises two shoulder straps 14, 16 and a belt 18 having a detachable buckle 20 and a length adjustment ring 22. A detachable buckle 24 and a length adjustment ring 22 are part of the front portion of each shoulder strap 14, 16. These detachable buckles 20, 24 and the length adjustment rings 22 provide adjustment means to fit one size of harness to persons of various measurements. Thus a limited number of sizes manufactured, such as kid, junior and adult sizes, satisfies the needs of all individuals needing it.

The shoulder straps 14, 16 are crossed over one another at the back of the harness and sewn together at the intersection 26. Other seams are provided at the intersections 28 of each shoulder strap 14, 16 with the rear segment of belt 18. The lower front end of each shoulder strap 14, 16 is attached to the belt 18 by means of a strap 30 encircling the belt 18. These straps 30 are not sewn to the belt 18 such that their positions along the belt 18 may be changed to satisfy the preference of the wearer.

The detachable buckles 24 on each shoulder strap 14, 16 are identical. Hence, the shoulder straps 14, 16 may be crossed over one another in the front to duplicate the "X" configuration of the rear part of the harness.

The pouch 12 of the preferred embodiment comprises a bag portion 32 and a flap 34 folding over the bag portion 32, enclosing the opening of the bag portion 32 completely. The back part of the bag portion 32 is sewn near the front segment of the belt 18. The size of the bag portion 32 is sufficient to contain the harness 10 entirely.

Figure 2:
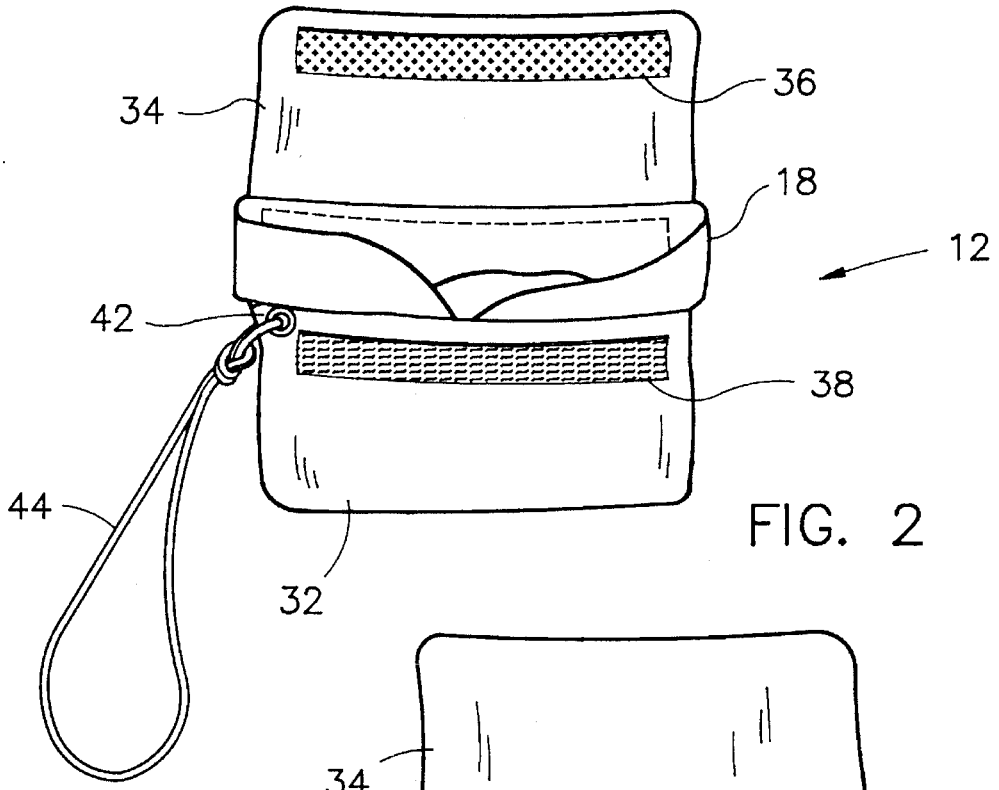
FIG. 2 is a front view of the pouch with the harness contained therein.
Figure 3:
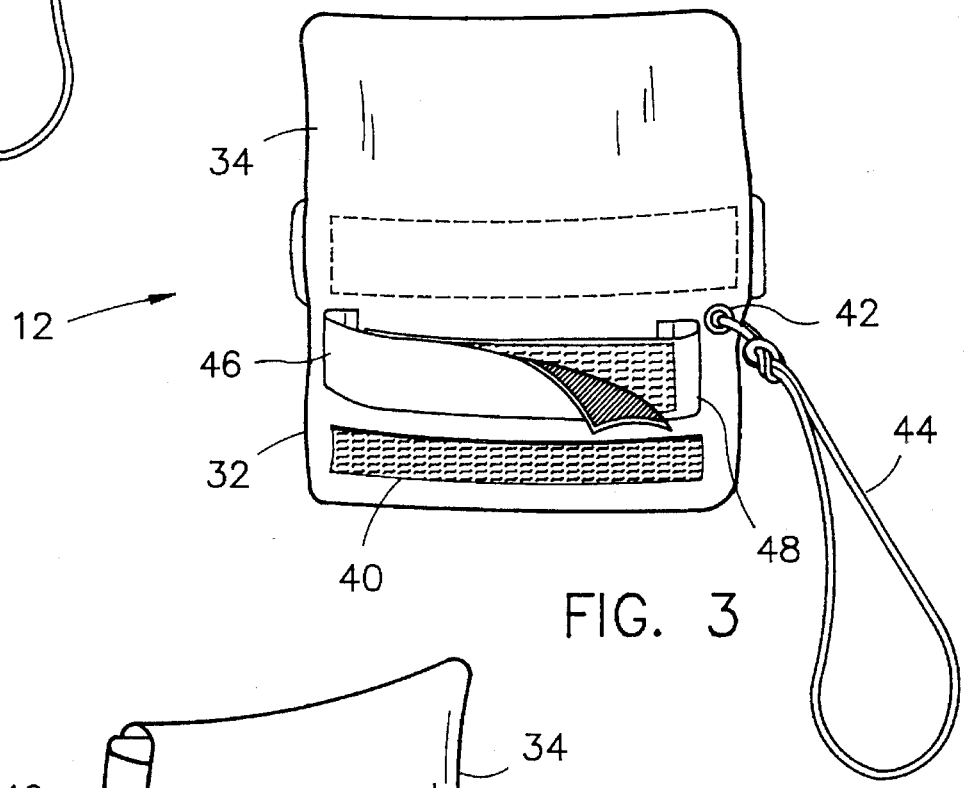
FIG. 3 is a rear view of the pouch illustrating the limb band.
Figure 4:
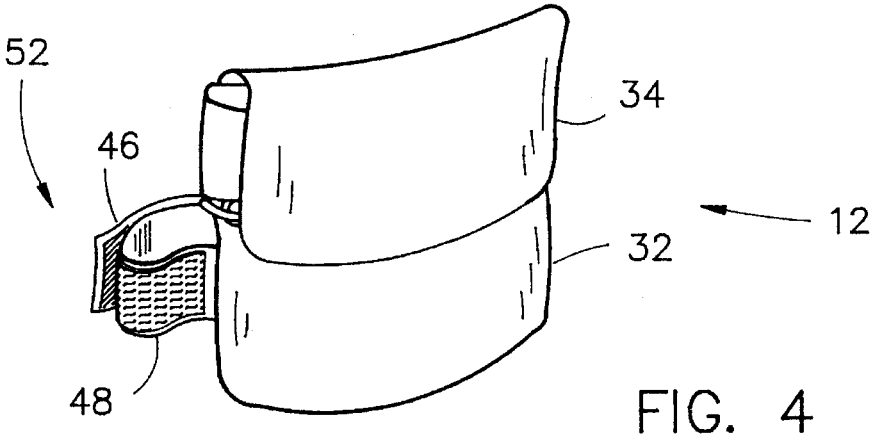
FIG. 4 is an oblique view of the pouch with the limb band partially deployed.

Referring now to FIGS. 2, 3 and 4, there is illustrated a reflective pouch 12 with a harness 10 stowed therein. The inside portion of the flap 34 has a strip of gripping material 36 which is made to align with a corresponding strip of mating material 38 on the outside front portion of the bag portion 32 when the flap 34 is folded over the opening of the bag portion 32. The gripping and the mating materials are of the type sold under the trade name VELCRO™.

Another strip of mating material 40 is attached to the lower outside back part of the bag portion 32 as shown on FIG. 3. The strip of mating material 40 aligns with the gripping material 36 when the bag portion 32 is folded over longitudinally. The pouch 12 takes thereby the shape of a cylindrical object as shown on FIGS. 5, 6 and 7.

The pouch 12 is equipped with an eyelet 42 and a carrying string 44. The string 44 is used to carry the cylindrical reflective object as a pendant 50 as shown on FIG. 5.

Referring back to FIGS. 3 and 4, there is illustrated a set of straps 46, 48 equipped with corresponding gripping and mating material, and attached to the rear part of the bag portion 32. The gripping and mating material provides the means to adjust the position of the strap 46 relative to strap 48 and thus to form a limb band 52 adjustable to various sizes. The band 52 is used to mount the reflective pouch 12 on someone's arm, or if preferred to mount it on a jogger's ankle as shown on FIG. 9.

Figure 5:
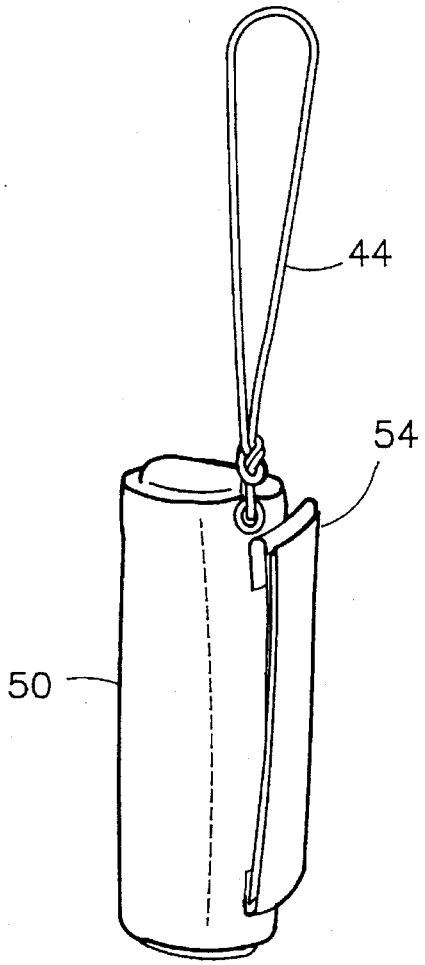
FIG. 5 illustrates the pouch folded into a reflective pendant.
Figure 6:
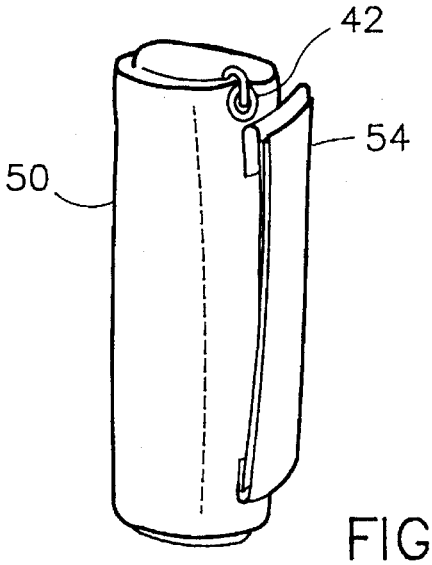
FIG. 6 illustrates the pendant of FIG. 5 with the holding cord stored inside the pouch.

The straps 46 and 48 can also be pulled together flat to form a narrow slot type opening 54 as illustrated on FIGS. 5 and 6. This slot 54 is suitable for securing the preferred embodiment to a belt. Thus this belt hook 54 is particularly useful to carry the cylindrical reflective signal 50 shown on FIG. 6 to the belt of various users such as night shift workers, boy scouts and hitch-hikers.

Figure 7:
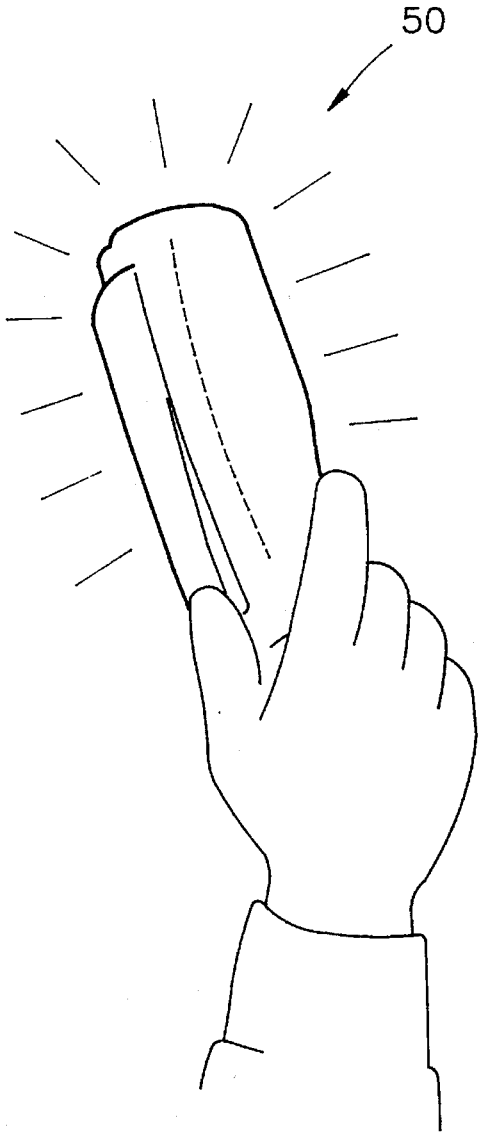
FIG. 7 illustrates a preferred use of the pendant of FIG. 6 as a hand held reflective signal.

Another suggested use of the preferred embodiment is to hold the reflective signal 50 in the hand as illustrated on FIG. 7 to direct traffic for example, or to give visual indications at night to distant persons.

Figure 8:
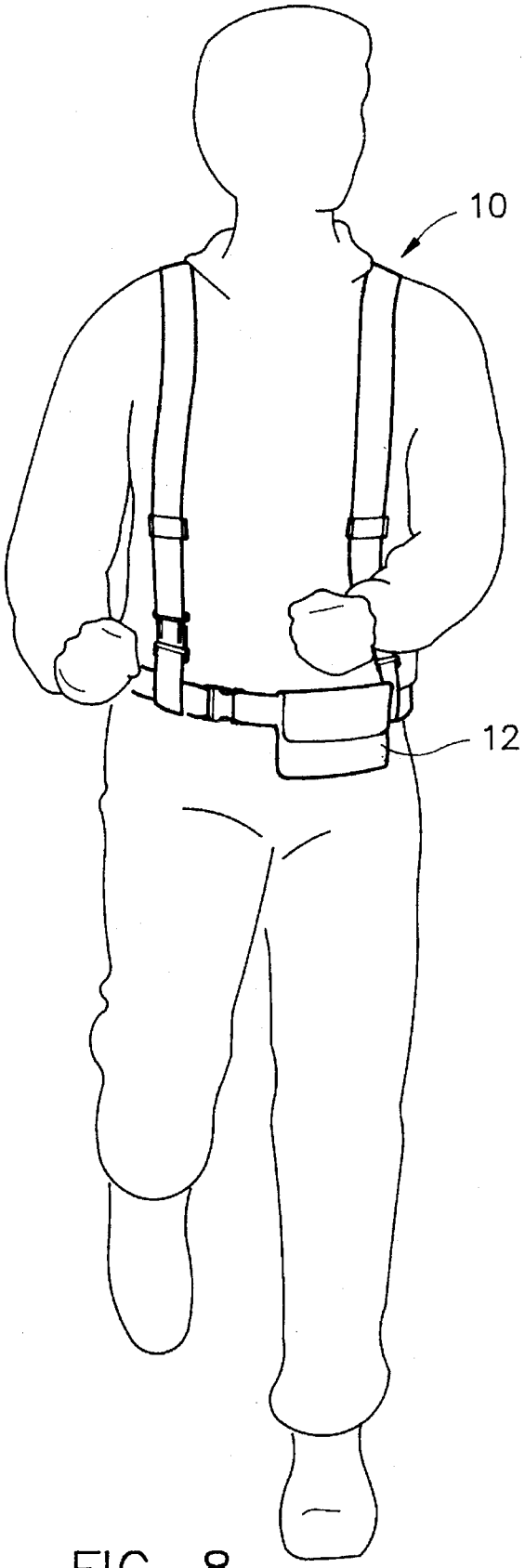
FIG. 8 shows the reflective garment worn by a jogger.

Referring now to FIGS. 8 to 11, there are illustrated additional suggested uses of the preferred embodiment. FIG. 8 illustrated a jogger wearing the reflective harness 10 and pouch 12 in a conventional manner. The position of the pouch 12 is convenient to carry car keys, a wallet, candies or other things of the like.

Figure 9:
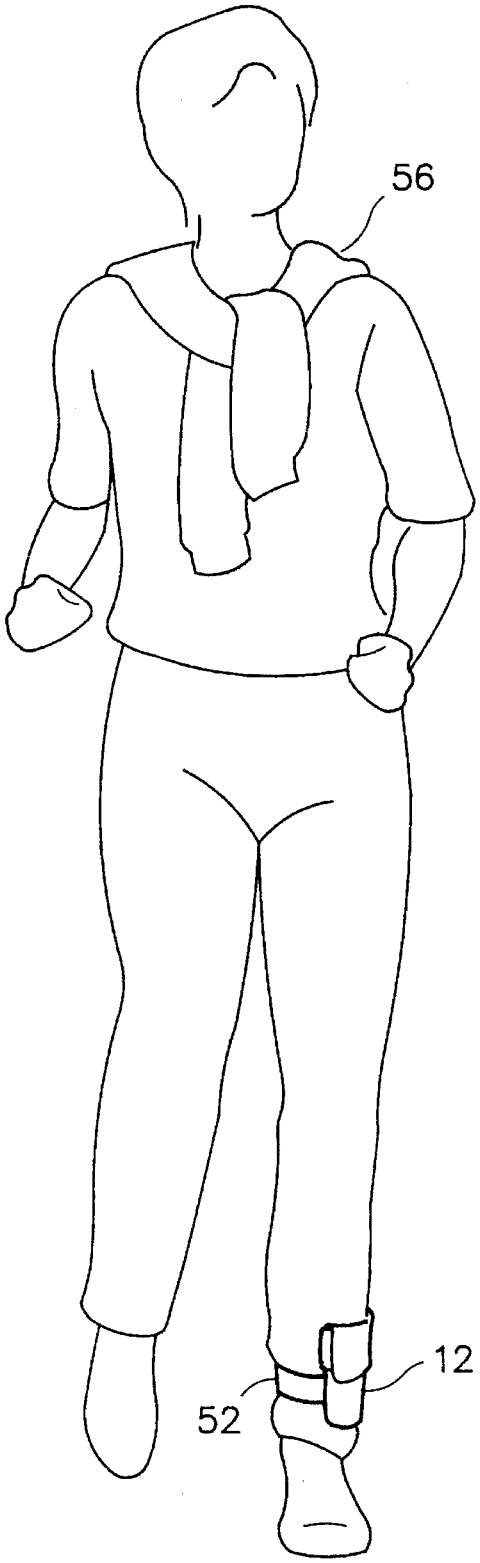
FIG. 9 shows another jogger wearing the transformable reflective garment as a leg reflector.

The lady jogger shown on FIG. 9 carries an extra sweater 56 on her shoulder. Therefore, the conventional harness 10 would not be visible from behind. In similar circumstances it is suggested to wear the preferred embodiment as a reflective pouch 12 attached to the person's ankle by means of the limb band 52. The substantial size of the pouch 12 and the continuous movement of the leg of a walker or of a jogger is sufficient to signal the presence of the wearer to incoming vehicles.

Figure 10:
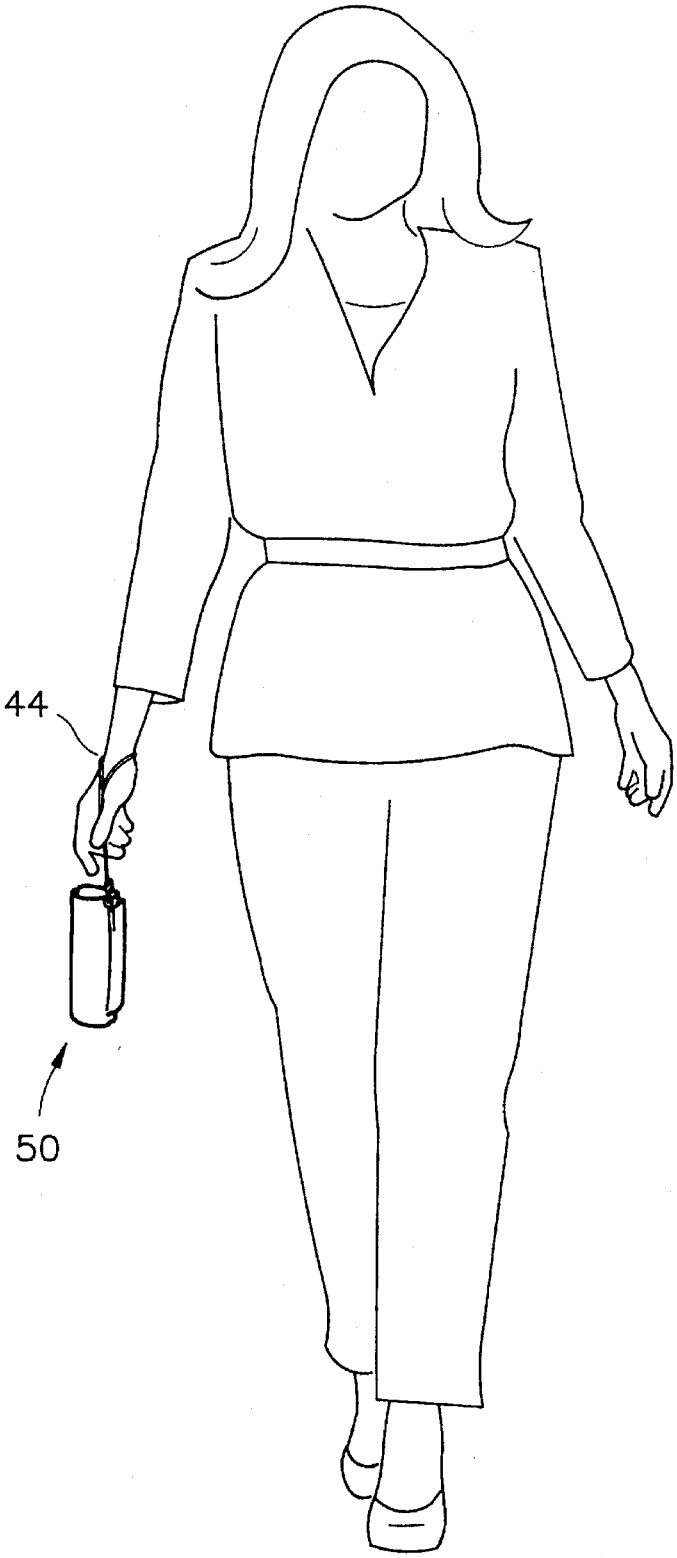
FIG. 10 illustrates a lady walking with the transformable reflective garment as a pendant.

Similarly, the lady shown on FIG. 10 chose to carry the reflective pendant 50 with the string 44 tied around her wrist. The moving signal 50 can be seen from far distances. The reflective pendant 50 offers considerable protection while respecting the desire of the appearance conscious individuals.

Figure 11:
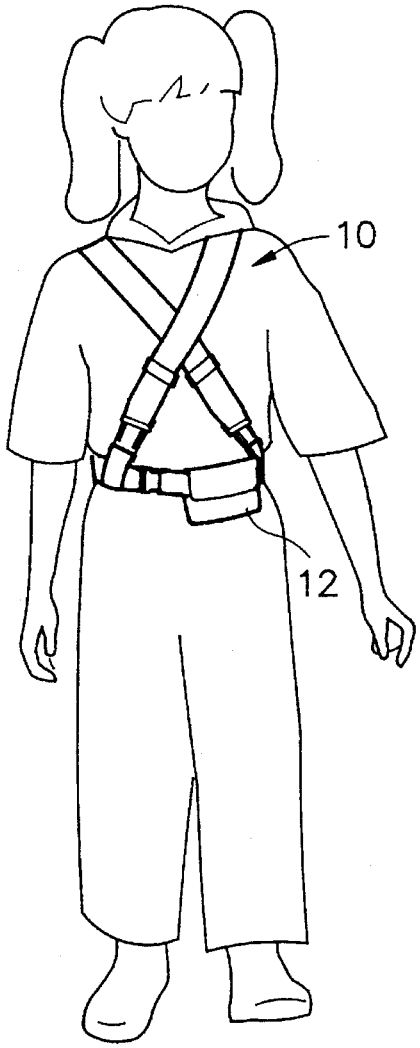
FIG. 11 illustrated a young girl wearing the reflective harness with the shoulder straps crossed over one another.

And most importantly, the transformable reflective garment can be used by kids as shown on FIG. 11. In this application, the shoulder straps of the harness 10 are crossed over one another to provide a "X" shape visual effect from the front as well as from behind the child. This arrangement is comfortable for the kids and stays in place despite extensive movement from playing.

The pouch 12 is mostly appreciated by kids to carry candies, pet rocks, marbles, and similar things. The pouch is in this case an incentive for encouraging the wear of the reflective harness.

While the preferred embodiment of the invention has been described as a combination of a reflective pouch and a reflective harness stowable in the pouch, which combination is transformable into a limb reflector, a hand held signal and a reflective pendant, other utilizations are possible without altering the structure of the invention.

Therefore the preferred embodiment of the invention as described herein is not limited thereto, and it will be apparent to those skilled in the art that numerous modifications form part of the present invention insofar as they do not depart from the spirit, nature and scope of the claimed and described invention.

I claim:

1. A pouch having a collapsed, folded body harness stowed therein, said pouch having a hollow conformation to retain said harness in a folded and stowed condition, said hollow conformation being closed by a flap extending from a portion thereof, said harness comprising two shoulder straps and a belt a front segment of which being attached across a surface of said flap, whereby said hollow conformation can be used by a wearer to carry personal objects when said harness is worn.

2. A pouch as claimed in claim 1 wherein, said pouch and said harness are made of a reflex-reflective fabric.

3. A pouch as claimed in claim 1 wherein, an intersection of each of said shoulder straps with said front segment is a loop encircling loosely said belt, such that a position of each said shoulder strap on said belt is variable to accommodate a preference of the wearer.

4. A pouch as claimed in claim 1 wherein, each of said shoulder straps comprises a detachable buckle and a length adjustment means, whereby each shoulder strap is either worn in a position parallel to one another or in a crossed over pattern, to accommodate a preference of the wearer.

5. A pouch as claimed in claim 1 comprising, a limb band for mounting said pouch, when said harness is contained therein, to an arm, a wrist, a leg or an ankle of the wearer.

6. A pouch as claimed in claim 1 wherein, said flap has a piece of gripping material cooperating with a piece of mating material attached to a front portion of said pouch.

7. A pouch as claimed in claim 6 wherein, a strip of mating material is attached to a lower rear portion of said pouch, said strip of mating material cooperates with said piece of gripping material of said flap when the lower portion of said pouch is folded under said flap, whereby said pouch with said harness contained therein is transformed into a cylindrical reflective signal.

8. A pouch as claimed in claim 7 comprising, a string for carrying said cylindrical signal as a reflective hand held pendant.

9. A pouch as claimed in claim 7 wherein, said pouch comprises a limb band, said limb band comprises a first strap having a piece of gripping material and a second strap having a piece of mating material, whereby said first strap and said second strap are positioned flatly over one another to cooperate and to form a narrow slot between said limb band and said pouch, wherein said narrow slot is used to retain said cylindrical reflective signal to a waistband of the wearer.

10. A reflecting garment to improve a visibility of a wearer when light is directed upon him, comprising;

a stowable harness and a pouch for receiving said harness, when said harness is not worn, said harness and said pouch being made of a reflex-reflective fabric, said harness comprising two shoulder straps and a belt collapsible to a compact form, said pouch being closed by a flap extending from a portion thereof, a front segment of said belt being attached across a surface of said flap, whereby said pouch can be used by the wearer to carry personal objects when said harness is worn.

11. A reflective garment as claimed in claim 10 wherein, an intersection of each of said shoulder straps with said front segment of said belt is a loop encircling loosely said belt, such that a position of each said shoulder strap on said belt is variable to accommodate a preference of the wearer.

12. A reflective garment as claimed in claim 10 wherein, each of said shoulder straps comprises a detachable buckle and a length adjustment means whereby each shoulder strap is either worn in a position parallel to one another or in a crossed over pattern, to accommodate a preference of the wearer.

13. A reflective garment as claimed in claim 10 wherein, said front segment of said belt includes a detachable buckle and a length adjustment means for adjusting a size of said belt to a measurement of the wearer.

14. A reflective garment as claimed in claim 10 wherein, said pouch includes a limb band for mounting said pouch, when said harness is contained therein, to an arm, a wrist, a leg or an ankle of the wearer.

15. A reflective garment as claimed in claim 10 comprising, a string for carrying said pouch when said harness is stowed therein, as a reflective hand held pendant.

16. A reflective garment as claimed in claim 10 wherein, said flap has a piece of gripping material cooperating with a piece of mating material attached to a front portion of said pouch.

17. A reflective garment as claimed in claim 16 wherein, a strip of mating material is attached to a lower rear portion of said pouch, said strip of mating material cooperates with said piece of gripping material of said flap when the lower portion of said pouch is folded under said flap, whereby said pouch with said harness contained therein is transformed into a cylindrical reflective signal.

18. A reflective garment as claimed in claim 17 wherein, said pouch comprises a limb band for mounting said cylindrical signal to an arm, a wrist, a leg or an ankle of the wearer.

19. A reflective .garment as claimed in claim 17 wherein, said pouch comprises a limb band, said limb band comprises a first strap having a piece of gripping material and a second strap having a piece of mating material, whereby said first strap and said second strap are positioned flatly over one another to cooperate and to form a narrow slot between said limb band and said pouch, wherein said narrow slot is used to retain said cylindrical reflective signal to a waistband of the wearer.

20. A reflective garment as claimed in claim 17 wherein, said pouch comprises a string for carrying said cylindrical signal as a reflective hand held pendant.

* * * * *